US006804832B2

(12) United States Patent
Béland

(10) Patent No.: US 6,804,832 B2
(45) Date of Patent: Oct. 19, 2004

(54) HOCKEY PANTS HAVING AN INTERCHANGEABLE PROTECTIVE UNIT

(75) Inventor: Jean-François Béland, Montreal (CA)

(73) Assignee: Bauer Nike Hockey Inc., St-Jérôme (CA)

( * ) Notice: Subject to any disclaimer, the term of this patent is extended or adjusted under 35 U.S.C. 154(b) by 96 days.

(21) Appl. No.: 10/157,835

(22) Filed: May 31, 2002

(65) Prior Publication Data

US 2002/0178483 A1 Dec. 5, 2002

(30) Foreign Application Priority Data

Jun. 1, 2001 (CA) ..... 2349450

(51) Int. Cl.[7] ..... A41D 13/02
(52) U.S. Cl. ..... 2/227
(58) Field of Search ..... 2/227, 79, 220, 2/235–237, 223, 238, 400, 403, 69, 401, 406, 464, 465, 467, 44

(56) References Cited

U.S. PATENT DOCUMENTS

| | | | | |
|---|---|---|---|---|
| 417,450 A | | 12/1889 | Van Duzer | |
| 759,765 A | | 5/1904 | Stall | |
| 759,833 A | | 5/1904 | Stall | |
| 841,514 A | | 1/1907 | Halligan | |
| 851,930 A | | 4/1907 | Greengerger | |
| 1,641,733 A | | 9/1927 | Bullock | |
| 1,757,640 A | * | 5/1930 | Levinson | 2/22 |
| 1,857,850 A | * | 5/1932 | Jones | |
| 1,915,754 A | * | 6/1933 | O'Shea | |
| 2,629,094 A | * | 2/1953 | Goldsmith | |
| 3,170,163 A | * | 2/1965 | Mitchell | |
| 3,484,868 A | * | 12/1969 | Davenport Jr. | |
| 3,787,892 A | * | 1/1974 | Quinn | |
| 4,325,148 A | * | 4/1982 | Livernois | |
| 4,577,356 A | * | 3/1986 | Hall | |
| 4,807,301 A | * | 2/1989 | Ferber | 2/465 |
| 5,050,244 A | * | 9/1991 | Kleinman | 2/227 |
| 5,365,610 A | * | 11/1994 | Lubahn et al. | |
| 5,926,856 A | * | 7/1999 | Duval | |
| 5,966,739 A | * | 10/1999 | Wagner | |
| 6,161,222 A | * | 12/2000 | Strickland et al. | 2/228 |
| 6,317,893 B1 | * | 11/2001 | Walton | 2/227 |
| 6,637,036 B2 | * | 10/2003 | Beland | 2/227 |

FOREIGN PATENT DOCUMENTS

CA 2325681 A1 5/2002

* cited by examiner

*Primary Examiner*—Tejash Patel

(57) ABSTRACT

A hockey pant assembly having an outer pant portion and an inner protective padding comprising a protective girdle and a pair of front thigh padding protectors. The inner protective padding is releasably connected as a unit to the outer pant such that it can be removed and installed quickly and easily in a variety of outer pants of different colors and designs.

13 Claims, 4 Drawing Sheets

HOCKEY PANTS HAVING AN INTERCHANGEABLE PROTECTIVE UNIT

FIELD OF THE INVENTION

The present invention relates to protective equipment for hockey and other such sporting activities. More specifically, the invention relates to protective pants having an interchangeable protective unit.

BACKGROUND OF THE INVENTION

In recent years, safety has become an issue of increasing importance in professional and amateur sports. Sports such as hockey, that often involve rough physical contact between players, require that the players devote an increased amount of attention towards their protection and physical safety. Thus, it is important that players have proper equipment to protect them from injury during a game.

Hockey pants are one of the most important pieces of protective equipment that hockey players wear. The Hockey pants cover the player's midsection from the waist to the knees and provide the needed protection to the player's upper leg and pelvic region so that injury to those areas may be prevented.

Hockey pants are not only worn to protect a player, they are also a very visible piece of equipment. The color of the hockey pants is an integral part of the hockey uniform that designates which team a player belongs to. Often, especially with amateur players, a player will belong to more than one hockey team, which means that for each team a player belongs to, he or she may be required to purchase in the colors of that team. This mean that a given player could have two or three different pairs of hockey pants, each in a different color.

Selling color-specific hockey pants could also be problematic for hockey equipment retailers. Hockey pants are reasonably expensive and it is possible that at the end of a season a retailer will find that say, all the hockey pants in blue and black (which turned out to be the most popular colors of the season) have been sold, but that a significant quantity of red hockey pants are still left over.

U.S. Pat. No. 5,926,856 (Duval) describes hockey pants having removable padding members. The protective hockey pant disclosed by Duval comprises an outer shell, multiple back padded members and an upper padded member. The upper padded member and the multiple back padded members can be releasably attached to the outer shell so that the shell can be laundered. A disadvantage of the hockey pant disclosed by Duval is that the front padded member, and each individual back padded member is a separate element. This makes removing and inserting the padding members a laborious, time consuming task. It also creates the added difficulty of remembering how each padding member fits back into the outer shell.

SUMMARY OF THE INVENTION

An object of the invention is to provide hockey pants that have interchangeable protective padding that is quick and easy to insert and remove from the hockey pant.

It is also an object of the present invention to provide a protective-padding unit that combines a plurality of padding elements into one piece.

It is a further object of the present invention to provide a one-piece protective padding assembly that can be attached or removed from within an outer hockey pant quickly and easily.

As embodied and broadly described herein, the present invention provides a hockey pant assembly comprising an outer pant having a right leg portion, a left leg portion and a pelvic region; and an inner protective padding comprising a protective girdle and a pair of front thigh padding protectors. The protective girdle comprises a rib padding protector and a hip padding protector. The inner protective padding is releasably connected to an upper portion of the outer pant; the inner protective padding adapted to be removable as a unit from said outer pant.

Advantageously, with a removable padding assembly the retailers would only have to stock one type of padding assembly, which is the more costly part of the hockey pant, and could then stock a variety of colors and styles of outer pants which are the less expensive part of the hockey pant. If there were some red outer pants left over at the end of the season, it would not be as big a loss to the retailer as to have completely assembled protective pants left over.

As embodied and broadly described herein, the present invention provides a hockey pant assembly kit comprising at least two outer pants each having a right leg portion, a left leg portion and a pelvic region; and an inner protective padding comprising a protective girdle and a pair of front thigh padding protectors. The inner protective padding is releasably connected one of the outer pants and is adapted to be removed from one of the outer pants and inserted into another one of the outer pants.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

A detailed description of the preferred embodiments of the present invention is provided herein below, by way of example only, with reference to the accompanying drawings, in which.

Figure 1:
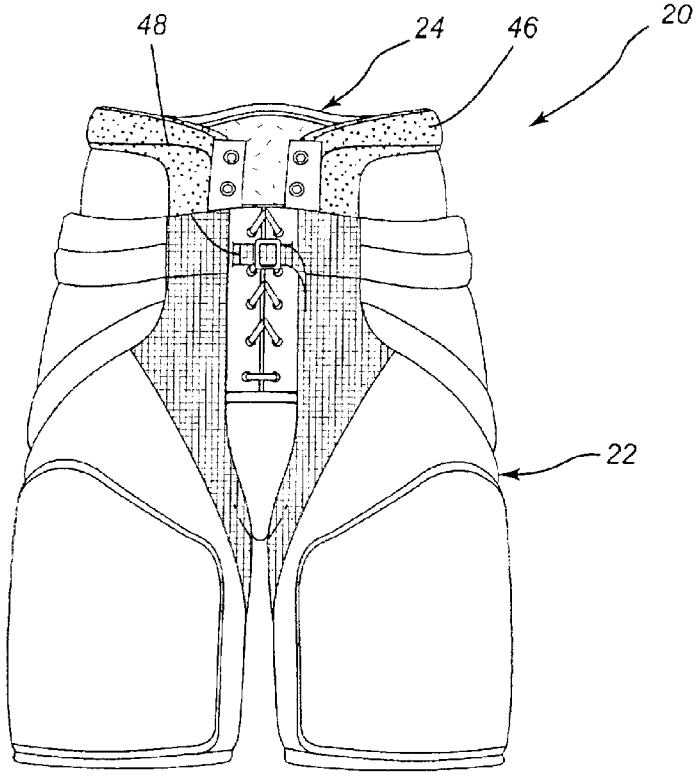
FIG. 1 is a front view of an assembled hockey pant and protective unit in accordance the present invention.

In the drawings, preferred embodiments of the invention are illustrated by way of examples. It is to be expressly understood that the description and the drawings are only for the purpose of illustration and as an aid to understanding. They are not intended to be a definition of the limits of the invention.

DETAILED DESCRIPTION OF THE PREFERRED EMBODIMENT

Figure 2:
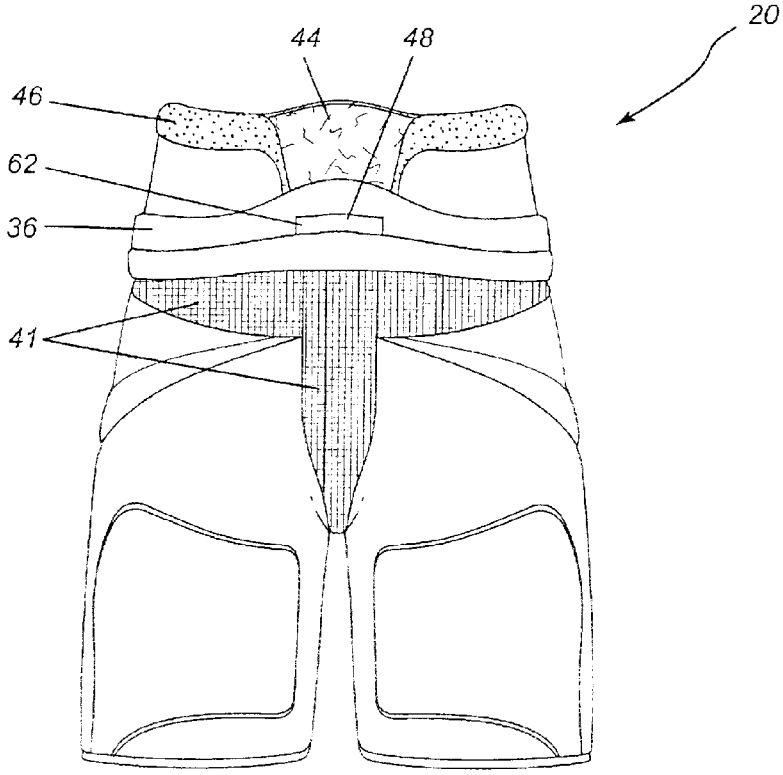
FIG. 2 is a back view of an assembled outer hockey pant and protective unit of FIG. 1.
Figure 3:
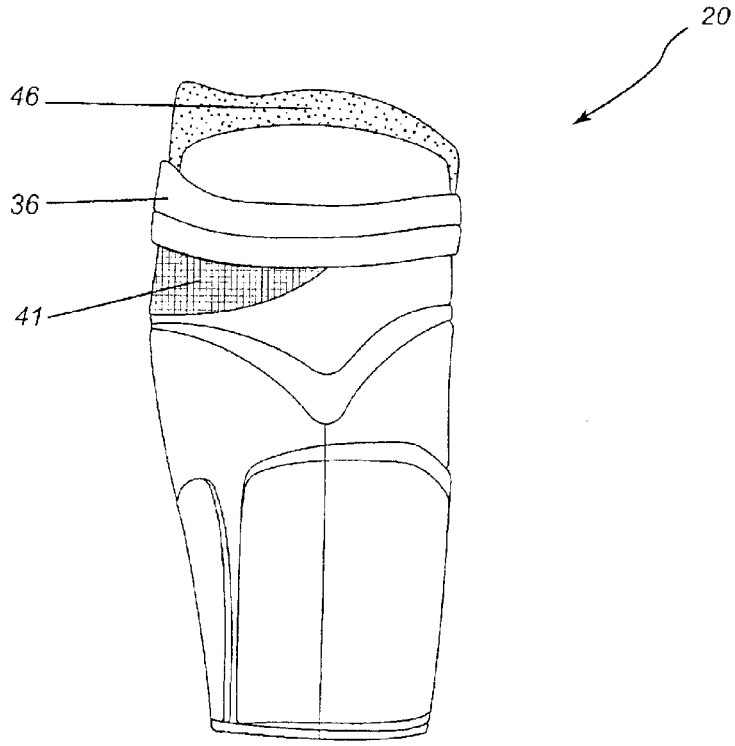
FIG. 3 is a side view of the assembled outer hockey pant and protective unit of FIG. 1.

Shown in FIGS. 1, 2 and 3 is a preferred embodiment of a hockey pant assembly 20 according to a preferred embodiment of the invention. Hockey pant assembly 20 comprises two parts, namely an outer pant 22 and an inner protective unit 24. Although not clearly visible in FIGS. 1, 2 and 3, inner protective unit 24 is the most substantial half of hockey pant assembly 20, both in terms of weight and in terms of importance. It is inner protective unit 24 that comprises most of the padding that will provide protection to the wearer. Outer pant 22 functions mostly as a covering for inner protective unit 24 and gives protective assembly 24 an aesthetically pleasing look. The two parts, outer pant 22 and inner protective unit 24, are designed to be attachable and detachable from one another. Therefore, a wearer may attach a variety of different outer pants 22 to protective unit 24, in order to have hockey pants of differing colors or styles.

Figure 4:
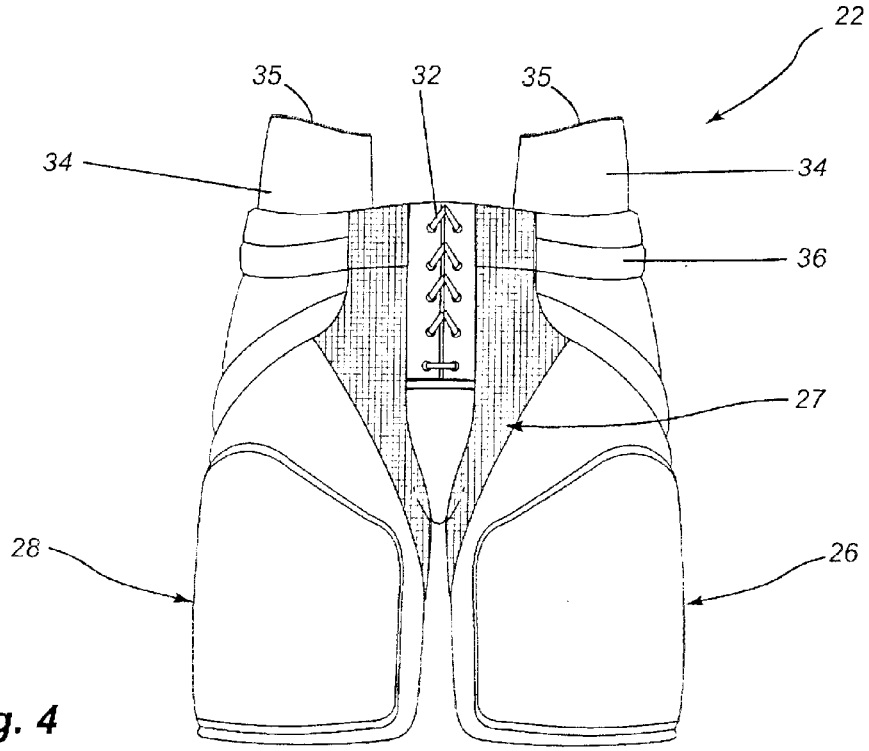
FIG. 4 is a front view of an outer hockey pant in accordance with the present invention without a protective unit.
Figure 5:
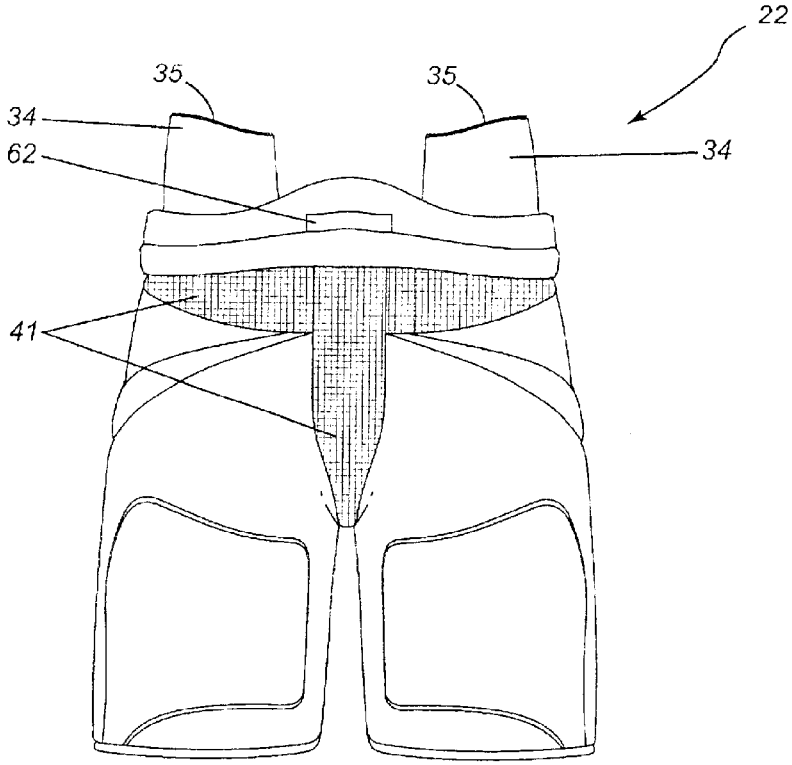
FIG. 5 is a back view the outer hockey pant of FIG. 4.

FIGS. 4 and 5 show outer pant 22 without inner protective unit 24. Outer pant 22 is preferably made of a single or multi layer nylon material that is resistant to rip and cuts. Other synthetic and natural materials are likewise contemplated for alternate embodiments. It is also preferable that outer pant 22 be made of a water resistant, if not water proof, material so that water from the ice does not soak through the pant and reach the wearer's skin.

Outer pant 22 is generally made to cover the portion of the wearer's body between the knees and the waist. As can be seen in FIG. 4, outer pant 22 comprises a left leg portion 26 that covers the wearer's left thigh, a right leg portion 28 that covers the wearer's right thigh, both of tubular configuration to encircle the thighs of the player. Outer pant 22 further comprises a pelvic portion 27 that covers the wearer's front and back pelvic and crotch regions to which is attached both left and right leg portions 26 and 28. As can be seen in FIG. 5, part of outer pant 22 is made of an elastic material 41 that provides flexibility.

Outer pant 22 comprises many decorative features as well as functional features. In the preferred embodiment shown in FIG. 4, outer pant 22 comprises a waist band 36 is padded and provides added protection around the waist of the player as well as enhancing the appearance of outer pant 22. Extending up from waist band 36 are two wings 34 that extend as high as the wearer's lower ribs. On the tip of the two wings 34 is half a zipper 35 for engaging with a second half of a zipper when outer pant 22 is to be assembled with protective unit 24. Button holes are also provided on the inside surface wings 34 (not shown) that allow outer pant 22 to be secured to inner protective unit 24.

Waist band 36 further comprises a handle 62 located in the rear of outer pant 22 (seen in FIG. 2 and FIG. 5) that is used for handling hockey pant 20 as well as suspending it on a hook in the dressing room.

Outer pant 22 further comprises a lace-up fly 32 that extends from slightly above the wearer's crotch to the wearer's waist. The lace-up fly 32 can be opened and closed to facilitate the putting on and removal of outer pant 22. Lace-up fly 32 further allows a wearer to tighten outer pant 22 so that outer pant 22 fits snugly around the wearer's hips. Although FIG. 4 shows a lace-up fly 32 it should be expressly understood that any type of securing means, such as a zipper or buttons, can be used to loosen and tighten outer pant 22.

Legs 26 and 28 of outer pant 22, each comprise an internal pocket in the front of the leg region (internal pockets not shown in the drawings) for further facilitating the attachment of protective unit 24 within outer pant 22. Although not shown in the drawings, it is possible for outer pant 22 to contain inner pockets on the rear side of the leg as well.

Figure 6:
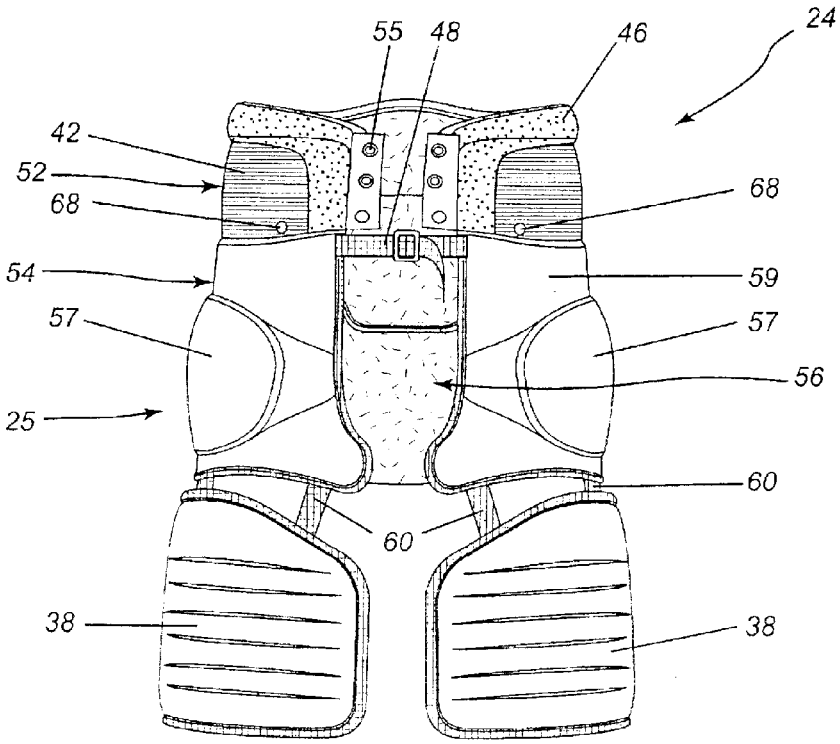
FIG. 6 is a front view of the protective unit of the present invention without the outer hockey pant.
Figure 7:
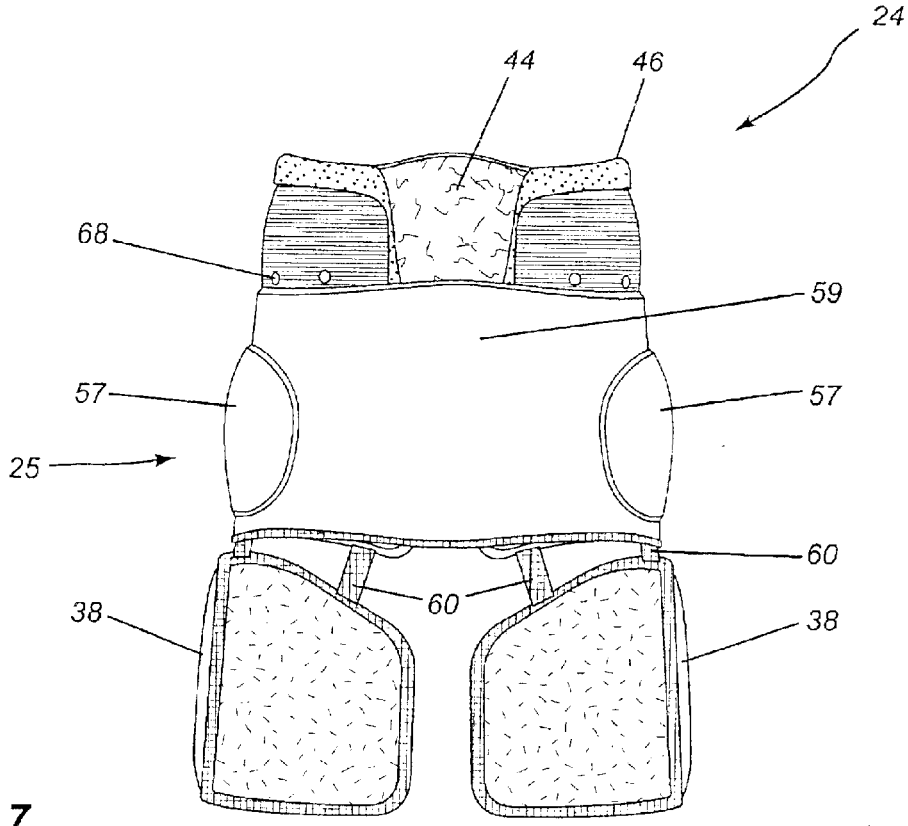
FIG. 7 is a back view of the protective unit of FIG. 6.
Figure 8:
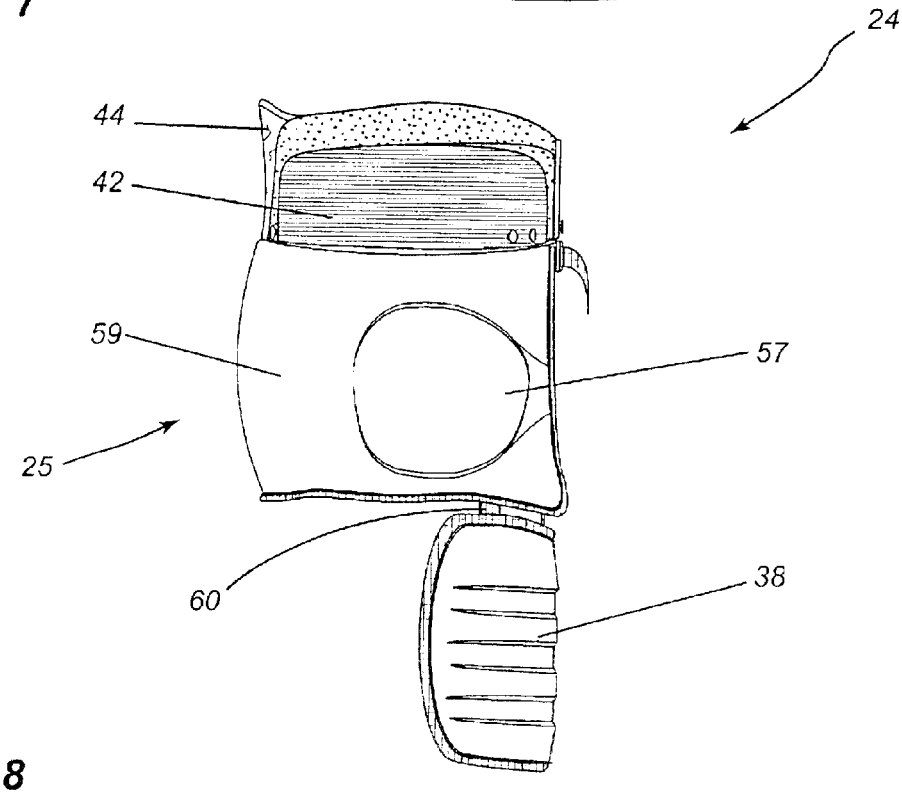
FIG. 8 is a side view of the protective unit of FIG. 6.

Inner protective padding unit 24 is shown in FIGS. 6, 7 and 8. Inner protective padding 24 consist of a protective girdle 25 that comprises most, if not all, of the padding elements generally included in the upper portion of a typical pair of hockey pants. Protective girdle 25 has an abdomen section 52 that fits around a wearer's body slightly above the waist and a pelvic padded region 54 surrounding the wearer's front and back pelvic and crotch regions. Thigh protectors 38 are connected to protective girdle 25 for covering the front and sides of the wearer's legs. Located at the abdomen section 52 of protective girdle 25, are rib protectors 42. Rib protectors 42 are made of semi-rigid padding that can absorb impact inflicted to the wearer's lower ribs.

A flap 46 runs along the upper portion of protective girdle 25 at a location slightly above rib protectors 42. Located underneath flap 46 is a half zipper for engaging with the other half of the zipper 35, located on the top of wings 34 of outer pant 22. Located at the bottom of rib protectors 42 are a plurality of buttons 68, which engage the button holes of outer pant 22.

As seen in FIG. 6, located around abdomen section 52 of protective girdle 25 is an adjustable belt 48. Adjustable belt 48 allows a wearer to tighten protective unit 24 around the wearer's body and enables the wearer to better adjust the fit of protective unit 24 and of hockey pant 20.

As can be seen in FIG. 7, at the back of protective unit 24, is a lower spine protector 44. Lower spine protector 44 is made of thick padding that can absorb impact inflicted to the wearer's lower back. Lower spine protector 44 extends higher than the front portion of protective unit 24 in order to cover a substantial portion of the wearer's lower back. It is important that spine protector 44 doesn't lose contact with the wearer's lower back when the wearer is bent over in the skating position which would leave the lower spine unprotected.

At the front of protective unit 24 is a gap 56 that is left to allow size adjustment of protective girdle 25. In use, the unprotected area left by gap 56 is filled with a jock strap normally worn by a hockey player. In a preferred embodiment shown in FIG. 6, in addition to adjustable belt 48 there are lace eyelets 55 located on either side of gap 56 at the abdomen region 52 so that a wearer may use a lacing chord to tighten the upper abdomen region 52. It should be expressly understood that any tightening mechanism could be incorporated into protective unit 24 in order to tighten gap 56.

The pelvic region 54 of protective girdle 25 is made up of a strong flexible material that forms a frame 59 to surround pelvic region 54. Frame 59 covers most of the area surrounding a wearer's hip, pelvis and upper leg, and covers the base of the wearer's back, as can be seen in FIG. 7, thereby protecting the wearer's coccyx. However, in order to better protect the wearer's hips, hip protectors 57 are attached to frame 59 at the region covering the wearer's hipbones. A wearer's hip region is particularly susceptible to hard blows and therefore requires the additional protection of hip protectors 57. In a preferred embodiment hip protectors 57 are made of two layers, namely an outside rigid layer, and an inside cushioned layer. These two layers facilitate complete absorption of any impact to the wearer's hip.

Depending from the lower end of frame 59 are the front thigh protectors 38. In this embodiment of protective unit 24, which is illustrated in FIGS. 6, 7 and 8, front thigh pads 38 are shown attached to frame 59 by straps 60. Straps 60 are made of a strong nylon-blend material and are sewn into both frame 59 and thigh protectors 38. There are two straps 60 attaching each thigh protector 38 to frame 59 in order to fasten thigh protectors 38 in place. Thigh protectors 38 may also be separate from protective girdle 24 and individually positioned into the pockets of outer pant 22 provided to that effect. Front thigh protectors 38 are made of rigid cushioned material formed to follow the contour of a wearer's leg when the wearer is in motion.

Straps 60 may be any form of flexible attachment means possible or may be absent altogether to form three separate components to be assembled with outer pant 22. Thigh protectors 38 are not connected to protective unit 24 and just remain inside the internal pockets of outer pant 22. In an alternate embodiment frame 59 could extend down to the thigh region, and be connected directly to thigh protectors 38.

As mentioned above, protective unit 24 and outer pant 22 are designed to be removably attached to one another in order to form a complete hockey pant assembly 20, as seen in FIGS. 1, 2 and 3. In preparation for playing hockey, the wearer must secure the two parts, outer pant 22 and protective unit 24 together. The first step in assembling outer pant 22 and protective unit 24, is to insert thigh protectors 38 within the inner pockets (not shown) of outer pant 22. The inner pockets maintain thigh protectors 38 in place on a wearer's leg so that they do not move out of place during movement of the wearer's legs.

In order to connect protective girdle 25 of protective unit 24 to outer pant 22, buttons 68 shown in FIGS. 6 and 7 are buttoned into the corresponding holes located on the interior surface of wings 34 (corresponding button holes are not shown in the drawings). While FIG. 6 depicts buttons, it should be expressly understood that any form of fastening means, such as Velcro™ or snaps, could be adopted instead. Any fastening means that connects outer pant 22 to protective unit 24 is within the scope of the present invention.

As described above protective unit 24 comprises half a zipper, which is located underneath flap 46 and outer pant 22 also comprises half a zipper 35, which is located on the rim of wings 34. In order to assemble the wings 34 to the rib protectors 42 of protective unit 24, the two halves of the zipper are connected. Flap 46 is then bent over the connected zipper and over a small portion of wings 34, thereby covering the zipper. Covering the zipper not only gives pant assembly 20 a more pleasing aesthetic look, it also increases safety by avoiding injuries to the wearer or other players due to contact with the zipper. Although a zipper is the preferred device for connecting wings 34 to protective unit 24, any fastening means such as Velcro™ or buttons is within the scope of the invention.

Once 22 and 24 are assembled, the only visible portions of 24 are flap 46, lower spine protector 44 and the frontal area of abdomen section 52. All these parts are made of a neutral color, such as black, so as to coordinate with as many colors of outer pant 22 as possible.

All the padding elements included in inner protective unit 24 are inserted and removed at the same time if all connected together or concurrently if inner protective unit 24 is in three parts. As described above, the assembly and disassembly of protective unit 24 and outer pant 22 is quick and easy. In the embodiment described above there are only the three steps for connecting the two parts together, namely inserting thigh protectors 38 within the inner pockets of outer pant 22, inserting buttons 68 within the button holes and finally, zipping the zipper located on the top of wings 34, and folding flap 46 over wings 34. The steps of assembling outer pant 22 and protective unit 24 may be done in any order and it should be understood that additional means for securing the two parts together are within the scope of the invention. It is also within the scope of the invention to have less than three means for connection. As an example, it would be sufficient to insert thigh protectors 38 within the inner pockets of outer pant 22 and to connect the zipper at the top of rib protectors 42. So long as the two parts are securely connected together, any method of attachment is within the scope of the invention.

Hockey pant assembly 20 is particularly useful for hockey players who play on more than one team and require hockey pants of differing colors (one for each team to which the player belongs). Once outer pant 22 has been removed from protective unit 24, a new or different pair of outer pants 22 can be attached to inner protective unit 24. In this way, a wearer must simply own one inner protective unit 24 and many outer pants 22, in order to have hockey pants of differing colors. Alternatively, when a wearer has worn-out outer pant 22, the wearer does not need to buy an entire new set of hockey pants. Instead, the wearer must simply purchase a new pair of outer pants 22.

The description of preferred embodiments should not be interpreted in a limiting manner since other variations, modifications and refinements are possible within the spirit and scope of the present invention. The scope of the invention is defined by the appended claims and their equivalents.

What is claimed is:

1. A hockey pant assembly comprising:

(a) an outer pant having a right leg portion, a left leg portion and a pelvic region; and (b) an inner protective padding comprising a pair of front thigh padding protectors and a protective girdle having a rib padding protector and a hip padding protector; said inner protective padding being releasably connected to an upper portion of said outer pant and being adapted to be removable as a unit from said outer pant.

2. A hockey pant assembly as described in claim 1, wherein said protective girdle further comprises an abdomen padding protection; a lower spine padding protection; and a coccyx protection.

3. A hockey pant assembly as defined in claim 1, wherein said outer pant and said inner protective padding are removably attached together by at least one zipper extending along the upper edge of said outer pant.

4. A hockey pant assembly as defined in claim 3, wherein said outer pant and said inner protective padding are removably attached by a combination of buttons and at least one zipper.

5. A hockey pant assembly as defined in claim 4, wherein a flap on said inner protective padding covers said at least one zipper.

6. A hockey pant assembly as defined in claim 5, wherein said outer pant includes inner pockets in the right and left leg portions.

7. A hockey pant assembly as defined in claim 6, wherein said thigh padding protectors are adapted to be placed within said inner pockets of said outer pants.

8. A hockey pant assembly as defined in claim 7, wherein said inner protective padding comprises an adjustable belt.

9. A hockey pant assembly as defined in claim 8, wherein said night and left leg portions are connected to said protective girdle by straps.

10. A hockey pant assembly as defined in claim 8, wherein said right and left leg portions are connected to said protective girdle by elastic bands.

11. A hockey pant assembly as defined in claim 1 wherein said outer pant is a first outer pant, said hockey pant assembly further comprising a second outer pant, said inner protective padding being releasably connected to an upper portion of each of said first and second outer pants and being adapted to be removable as a unit from each of said first and second outer pants, said first and second outer pants being of different colors.

12. A hockey pant assembly comprising:

(a) an outer pant having a right leg portion, a left leg portion and a pelvic region; and (b) an inner protective padding comprising a pair of front thigh padding protectors and a protective girdle having a rib padding protector and a hip padding protector; said inner protective padding being releasably connected to an upper portion of said outer pant and being adapted to be removable as a unit from said outer pant;

wherein said right and left leg portions are connected to said protective girdle by straps.

13. A hockey pant assembly comprising:

(a) an outer pant having a right leg portion, a left leg portion and a pelvic region; and (b) an inner protective padding comprising a pair of front thigh padding protectors and a protective girdle having a rib padding protector and a hip padding protector; said inner protective padding being releasably connected to an upper portion of said outer pant and being adapted to be removable as a unit from said outer pant;

wherein said right and left leg portions are connected to said protective girdle by elastic bands.

* * * * *

UNITED STATES PATENT AND TRADEMARK OFFICE

CERTIFICATE OF CORRECTION

PATENT NO. : 6,804,832 B2
DATED : October 19, 2004
INVENTOR(S) : Jean-François Béland It is certified that error appears in the above-identified patent and that said Letters Patent is hereby corrected as shown below:

Column 6,
Line 53, delete “night” and insert -- right --

Signed and Sealed this

Eighth Day of February, 2005

JON W. DUDAS
*Director of the United States Patent and Trademark Office*